US005594665A

United States Patent [19]

Walter et al.

[11] Patent Number: 5,594,665

[45] Date of Patent: Jan. 14, 1997

[54] PROCESS AND DEVICE FOR MONITORING AND FOR CONTROLLING OF A COMPRESSOR

[75] Inventors: Hilger A. Walter, Stade; Herwart Hönen, Uebach-Palenberg; Heinz E. Gallus, Aachen, all of Germany

[73] Assignee: Dow Deutschland Inc., Stade, Germany

[21] Appl. No.: 246,906

[22] Filed: May 20, 1994

[30] Foreign Application Priority Data

Aug. 10, 1992 [EP] European Pat. Off. ..... 92 113 586

[51] Int. Cl.[6] ..... G01H 3/00; G01H 7/00; F03B 15/00

[52] U.S. Cl. ..... 364/558; 364/508; 364/431.02; 73/660; 415/26

[58] Field of Search ..... 364/558, 431.02, 364/505, 508, 494; 73/116, 660; 417/20, 43; 415/26; 60/39.29

[56] References Cited

U.S. PATENT DOCUMENTS

| | | | |
|---|---|---|---|
| 3,003,970 | 10/1961 | Call | 252/152 |
| 3,132,562 | 5/1964 | Frevel | 89/1.7 |
| 3,216,244 | 11/1965 | Borchers | 73/115 |
| 3,244,006 | 4/1966 | Delmonte | 73/398 |
| 3,259,650 | 7/1966 | Decker et al. | 260/515 |
| 3,468,322 | 9/1969 | Katzer | 137/1 |
| 3,581,572 | 6/1971 | Frick | 73/406 |

(List continued on next page.)

FOREIGN PATENT DOCUMENTS

| | | |
|---|---|---|
| A0024823 | 3/1981 | European Pat. Off. . |
| 0465696 | 1/1992 | European Pat. Off. . |
| 2248427 | 5/1975 | France . |
| 2049338 | 4/1971 | Germany . |
| A3605958 | 9/1987 | Germany . |
| 57-129297 | 8/1982 | Japan . |
| 2191606 | 12/1987 | United Kingdom . |

OTHER PUBLICATIONS

*Combusion and Flame*, vol. 25, No. 1, 1 Aug. 1975, New York, pp. 5–14.

Y. Mizutani et al., "A Study on the Structure of Premixed Turbulent Flames by the Microphone–Probe Technique", pp. 6–7.

Int'l Patent Appl. No. PCT/US93/05765, filed Jun. 16, 1993.

European Patent Appl. No. 92113607.3, filed Aug. 10, 1992.

Int'l Patent Appl. No. PCT/US93/05764, filed Jun. 16, 1993.

European Patent Appl. No. 92113586.9, filed Aug. 10, 1992.

Int'l Patent Appl. No. PCT/US93/05766, filed Jun. 16, 1993.

European Patent Appl. No. 92113606.5 filed Aug. 10, 1992.

Int'l Patent Appl. No. PCT/US93/05768, filed Jun. 16, 1993.

European Patent Appl. No. 92113585.1, filed Aug. 10, 1992.

"Fast Response Wall Pressure Measurement as a Means of Gas Turbine Blade Fault Identification", K. Nathioudakis et al., Gas Turbine & Aeroengine Congress Expo, Brussels, Belgium, Jun. 11–14 1990, ASME Paper No. 90–GT. 341.

"Rotating Waves as a Stall Inception Indication in Axial Compressors", V. H. Garnier et al., Gas Turbine & Aeroengine Congress and Expo, Brussels, Belgium ASME paper No. 90–GT–156.

Hönen, Herwart, "Experimental Studies of the Three–D-inemsional Unsteady Flow Behavior in a Subsonic Axial Compressor Stage," Jun. 24, 1987.

*Primary Examiner*—Emanuel T. Voeltz
*Assistant Examiner*—Eric W. Stamber
*Attorney, Agent, or Firm*—Dale H. Schultz

[57] ABSTRACT

A process and a computer implemented system for controlling an axial compressor through measurement of pressure fluctuations of the turbulent fluid layer in the region of the compressor housing in at least one stage of the compressor by means of at least one pressure sensing device sensitive to differential pressure fluctuations affecting the blades at the characteristic frequency of the stage. The process and computer implemented system use a characteristic peak which emerges under load in a smoothed frequency signal derived from a transform of the pressure measurement to achieve optimal efficiency while, at the same time, avoiding destructive surge and stall conditions in the compressor.

36 Claims, 6 Drawing Sheets

U.S. PATENT DOCUMENTS

| | | | |
|---|---|---|---|
| 4,026,111 | 5/1977 | Matthews | 60/641 |
| 4,052,857 | 10/1977 | Altschuler | 60/641 |
| 4,055,994 | 11/1977 | Roslyng et al. | 73/116 |
| 4,058,015 | 11/1977 | Stode | 73/395 |
| 4,072,619 | 2/1978 | Williams et al. | 252/47.5 |
| 4,196,472 | 4/1980 | Ludwig et al. | 364/431 |
| 4,216,672 | 8/1980 | Henry et al. | 73/115 |
| 4,252,498 | 2/1981 | Radcliffe et al. | 415/26 |
| 4,256,511 | 3/1981 | Atchison et al. | 134/46 |
| 4,311,040 | 1/1982 | Long | 73/115 |
| 4,322,977 | 4/1982 | Sell et al. | 73/701 |
| 4,364,266 | 12/1982 | Williams | 73/115 |
| 4,414,817 | 11/1983 | Jernigan | 60/641.2 |
| 4,422,125 | 12/1983 | Antonazzi et al. | 361/283 |
| 4,422,333 | 12/1983 | Leon | 73/660 |
| 4,422,335 | 12/1983 | Ohnesorge et al. | 73/724 |
| 4,434,664 | 3/1984 | Antonazzi et al. | 73/701 |
| 4,449,409 | 5/1984 | Antonazzi | 73/724 |
| 4,457,179 | 7/1984 | Antonazzi et al. | 73/701 |
| 4,500,500 | 2/1985 | Paalman et al. | 423/224 |
| 4,528,817 | 7/1985 | Jernigan | 60/641.2 |
| 4,604,702 | 8/1986 | Zwicke | 364/431.02 |
| 4,618,856 | 10/1986 | Antonazzi | 340/626 |
| 4,625,280 | 11/1986 | Couch | 364/431.02 |
| 4,629,608 | 12/1986 | Lampton, Jr. et al. | 423/226 |
| 4,648,711 | 3/1987 | Zachary | 356/44 |
| 4,808,235 | 2/1989 | Woodson et al. | 134/22.19 |
| 4,902,563 | 2/1990 | McCullough, Jr. et al. | 428/284 |
| 4,921,683 | 5/1990 | Bedell | 423/235 |
| 4,926,620 | 5/1990 | Donle | 55/89 |
| 4,978,571 | 12/1990 | McCullough, Jr. et al. | 428/263 |
| 4,989,159 | 1/1991 | Liszka et al. | 364/508 |
| 4,995,915 | 2/1991 | Sewell et al. | 134/22.14 |
| 5,165,845 | 11/1992 | Khalid | 415/17 |
| 5,375,412 | 12/1994 | Khalid et al. | 60/39.29 |
| 5,394,330 | 2/1995 | Horner | 73/116 |
| 5,400,256 | 3/1995 | Beale et al. | 364/508 |
| 3,679,382 | 7/1972 | Cohrs et al. | 44/7 |
| 3,820,963 | 6/1974 | Moore et al. | 44/62 |
| 3,963,367 | 6/1976 | Stalker et al. | 415/17 |

| LOAD | p13 | p12 | p11 | STALL-LEVEL |
|---|---|---|---|---|
| L1 ↑ | ↑↑ | ↑ | ↑ | – |
| L2 ↑↑ | ↓↓ | ↑↑ | ↑ | – |
| L3 ↑↑↑ | ↓↓ | ↓↓ | ↑↑ | ↑ |
| L4 ↑↑↑↑ | ↓↓ | ↓↓ | ↓↓ | ↑↑ |

PROCESS AND DEVICE FOR MONITORING AND FOR CONTROLLING OF A COMPRESSOR

CROSS-REFERENCE TO RELATED APPLICATION

This application is a continuation-in-part application of International Patent Application No. PCT/US93/05764 which was filed on Jun. 16, 1993, and which designates the United States of America, and which claims International Priority from European Patent Application No. 92113586.9 which was filed on Aug. 10, 1992.

FIELD OF THE INVENTION

The present invention relates to a process and a device for monitoring and controlling of a compressor, said compressor comprising a rotor and a housing, said rotor being rotatably mounted within said housing for rotation about a rotational axis with variable or constant rotational speed, said compressor further comprising at least one compressor stage, each of said at least one stages comprising a row of rotor blades mounted on said rotor and being arranged one following the other in a circumferential direction with respect to said rotational axis and of a row of stator blades mounted on said housing and being arranged one following the other in a circumferential direction with respect to said rotational axis.

The invention provides for an early detection and reporting of changes in blade loading for either multi-stage or single-stage compressors with the added capability of being able to control the compressor in accordance with the reported changes. A compressor may be operated an isolated unit for example, as a large pump or a process compressor in the chemical or petroleum industries or in conjunction with a power-turbine engine, as would be the case in a power plant operation. The compressor may further be part of a gas turbine used for driving aeroplanes, ships or large vehicles. The compressor may be a radial type compressor or, preferably, an axial type compressor.

BACKGROUND OF THE INVENTION

Compressors consist of a series of rotating and stationary blade rows in which the combination of a rotor (circular rotating blade row) and a stator (circular stationary blade row) forms one stage. Inside the rotor, kinetic energy is transferred to the gas flow (usually air) by the individual airfoil blades. In the following stator, this energy is manifested as a pressure rise in the gaseous air as a consequence of deceleration of the gaseous air flow. This deceleration of the gaseous air flow is induced as a result of the design of the stator section. The pressure ratio (exit pressure/inlet pressure) of a single stage is limited because of intrinsic aerodynamic factors, so several stages are connected together in many turbo compressors to achieve higher pressure ratios than could be achieved by a single stage.

The maximum achievable pressure ratio of a turbo compressor is established by the so-called stability limit of the compressor given by the characteristic of the compressor and the gaseous air flowing through the compressor at any time. As the pressure in the compressor increases, the aerodynamic loading on the compressor blades must also increase. At full speed operation of a multi stage compressor, the rear stages carry the majority of the aerodynamic load (and attendant stress), and the stability limit is established by the limits inherent in the design of these stages. When operating at lower speeds, the stability limit of the compressor is established by limitations deriving from characteristics related to the front stages of the compressor.

In the normal stable working range of a compressor stage, axial flow of gaseous air through all of the vane channels between the compressor blades takes place equally and continuously as the air volume is transported through the channels. However, a compressor stage can also operate in a state known as an unstable working range. In this unstable working range, a stall condition can be present in the interaction between the air flow and the airfoil blades which can contribute to substantial variations in the internal pressure profile of the compressor. These pressure variations can, in turn, cause substantial stress to the blades of the compressor. Ultimately, this stress can damage the blades if the compressor continues to operate in the unstable working range for any length of time. Operation in the unstable working range is inefficient at best and potentially destructive; this mode of operation should be avoided as much as possible.

The development of a stall in a stage of the compressor proceeds from the interaction of individual airfoil blades with the gaseous air flowing through the vanes associated with those individual blades. Ideally, the gaseous air fluid flow should be axially continuous through the compressor; however, high blade loads can induce localized disruptions to that continuous flow.

The air fluid flow around each blade has an associated flow boundary layer which covers each blade and coheres to the blade. The flow boundary layer associated with a rotor blade will rotate as an associated entity of the blade as the blade itself rotates. At the downstream edge of each blade, this flow boundary layer melds into an associated flow boundary entity known as, alternatively, the Dellenregion, wake region, or delve region which is characterized by a localized reduction in both pressure and flow velocity. With increasing load, this wake region correspondingly will extend until a critical mass or size is achieved; when the wake region on the downstream edge of the blade achieves this critical size, it fractures or fragments into (1) a (new) smaller wake region which is still coherent with the blade and (2) a "flow boundary layer part" which physically separates from the wake region. Studies have indicated that these "flow boundary layer parts", separated from the rotor blades, move radially outwards from the axis of rotation due to centrifugal forces and collect at the inner circumferential surface of the compressor housing. This collection of separated flow boundary layer parts "swirls" and effectively establishes a turbulent fluid layer (or collection of swirled separated regions) at the inner surface of the housing; this turbulent fluid layer has associated stochastic pressure fluctuations which are useful in the present invention. For the purpose of this disclosure, this initial state associated with an increasing compressor loading will be termed as a "separated flow pre-stall".

With further increasing load, disrupted flow zones downstream of the blades expand in size and/or increase in number. Disruption of the continuous air flow through either groups of non-contiguous single-blade channels or whole sections of contiguous blade channels may occur. This blockage may be characterized as a sort of "bubble-like" entity which, in general, moves circumferentially throughout the stage with a rotational speed up to 0.5 times the rotor frequency. This phenomenon is known as "rotating stall". In stages with large blade heights, only the radially outer part of the blade channels is blocked and this situation is known as a "full span stall". With increasing load, the entire set of blade channels in a stage can be effectively blocked, resulting in an event and condition known as a "full span stall". In case of compressor stages having small overall diameters, "full span stall" can occur directly without transition through "part span stall" status.

Another phenomenon, which may derive from rotating stall or also may occur suddenly with increased blade loading, is the "compressor surge". In this state, the whole circumference of one stage (usually the last one) has stalled (full span stall in the full blading). Then, the compressor cannot work any longer against the back-pressure of this one stage and the flow in the compressor breaks down. The high pressure gas flows back from the outlet to the compressor intake until the pressure at the compressor outlet is reduced enough so that a moderate blade load allows normal working again. When the back pressure is not reduced, this changing operation will be continued. These fluctuations will take place with very low frequencies (typically a few Hertz) and will destroy the compressor within a short time of operation because the rotor is respectively shifted axially fore and aft. Furthermore, the compressor surge will be accompanied by fluctuations in the continuous overall air flow to the firing chamber in case of a gas turbine; these fluctuations can disrupt the environment in the firing chamber of the turbine in such a manner as to extinguish the "flame" in the firing chamber or (in some rare instances) establish the prerequisite environment for a backfire of the turbine through the compressor. A compressor should not be operated under such conditions; at best, operation will be inefficient for those stages wherein stall effects occur.

On the other hand, it is desirable to operate a compressor in an optimally efficient manner (that is as close as possible to the appropriate maximum obtainable mass flow rate given by the overall status of the compressor). Contemporary turbo engines are usually equipped with fuel or energy control systems which measure and output a variety of operating parameters for the overall engine. Included in such control systems are highly accurate pressure sensing devices or systems. For example, a pressure measuring system is described in PCT Publication (with International Publication Number WO 94/03785 filed Jun. 16, 1994 and published Feb. 17, 1994) titled ADAPTOR FOR MOUNTING A PRESSURE SENSOR TO A GAS TURBINE HOUSING. This publication shows a preferred pressure measuring system for use in the invention. Material from this publication is also presented with respect to FIG. 7, FIG. 8, and FIG. 9. Other examples of pressure measuring systems are described in U.S. Pat. No. 4,322,977 entitled "Pressure Measuring System", filed May 27, 1980 in the names of Robert. C. Shell, et al; U.S. Pat. No. 4,434,664 issued Mar. 6, 1984, entitled "Pressure Ratio Measurement System", in the names of Frank J. Antonazzi, et al.; U.S. Pat. No. 4,422,335 issued Dec. 27, 1983, entitled "Pressure Transducer" to Ohnesorge, et al.; U.S. Pat. No. 4,449,409, issued May 22, 1984, entitled "Pressure Measurement System With A Constant Settlement Time", in the name of Frank J. Antonazzi; U.S. Pat. No. 4,457,179, issued Jul. 3, 1984, entitled "Differential Pressure Measuring System", in the names of Frank J. Antonazzi, et al.; and U.S. Pat. No. 4,422,125 issued Dec. 20, 1983, entitled "Pressure Transducer With An Invariable Reference Capacitor", in the names of Frank J. Antonazzi, et al.

U.S. Pat. No. 4,216,672 to Henry et al, discloses an apparatus for detecting and indicating the occurrence of a gas turbine engine stall which operated by sensing sudden changes in a selected engine pressure. A visual indication is also provided.

U.S. Pat. No. 4,055,994 to Roslyng et al discloses a method and a device of detecting the stall condition of an axial flow fan or compressor. The method and device measure the pressure difference between the total air pressure acting in a direction opposite to the direction of the revolution of the fan wheel and a reference pressure corresponding to the static pressure at the wall of a duct in substantially the same radial plane.

U.S. Pat. No. 4,618,856 to Frank J. Antonazzi discloses a detector for measuring pressure and detecting a pressure surge in the compressor of a turbine engine. The detector is incorporated in an analog to a digital pressure measuring system which includes a capacitive sensing capacitor and a substantially invariable reference capacitor.

While a wide variety of pressure measuring devices can be used in conjunction with the present invention, the disclosures of the above-identified patents and the articles mentioned next are hereby expressly incorporated by reference herein for a full and complete understanding of the operation of the invention.

The article "Rotating Waves as a Stall Inception Indication in Axial Compressors" of V. H. Garnier, A. H. Epstein, E. M. Greitzer as presented at the "Gas Turbine and Aeroengine Congress and Exposition" from Jun. 11 to 14, 1990, Brussels, Belgium, ASME Paper No. 90-GT-156, discloses the observation of rotating stall. In case of a low speed compressor, the axial velocity of air flow is measured by several hot wire anemometers distributed around the circumference of the compressor. From the respective sensor signals, complex Fourier coefficients are calculated, which coefficients contain detailed information on the wave position and amplitude as a function of time of a wave traveling along the circumference of the compressor. These traveling waves are to be identified with rotating stall waves. In case of a high speed compressor, several wall mounted, high-response, static pressure transducers are employed, from which sensor signals first and second Fourier coefficients are being derived. However, this direct spectral approach does not directly yield information on compressor stability, since the height of the rotating stall wave peak is a function of both the damping of the system and the amplitude of the excitation. To estimate the wave damping, a damping model is fitted to the data for an early time estimate of the damping factor. By this technique, a rather short warning time may be available (in the region of tens to hundreds of rotor revolutions) to take corrective action (changing the fuel flow, nozzle area, vane settings etc.) to avoid compressor surge.

In the article "Fast Response Wall Pressure Measurement as a Means of Gas Turbine Blade Fault Identification" of K. Nathioudakis, A. Papathanasious, E. Loukis and L. Papailiou, as presented at the "Gas Turbine and Aeroengine Congress and Exposition" at Brussels, Belgium, from Jun. 11–14, 1990, ASME Paper No. 90-GT-341, it is mentioned that rotating stall is accompanied by the appearance of distinct waveforms in the measured pressure, corresponding to a rotational speed which is a fraction of the shaft rotational speed.

The systems known in the art cannot detect an unstable operating condition based on the preliminary indications of instability. They can only detect well established unstable conditions in an advanced state and, therefore, must avoid operation in the region where damage could result to the compressor from the more subtle kinds of instability. In order to avoid operation in the region where damage could result to the compressor, prior art compressor control systems operate with a high safety margin; this margin is well below the maximum possible mass flow rate of the compressor. In effect, the prior art compressor must therefore operate in a less efficient and a less economical mode than be realized with the subject of this invention.

Furthermore, the prior art control systems can detect an existing tendency of the compressor towards a stall condition or a surge condition only at a very short time before the actual occurrence of stall or surge. In many cases there is not enough time left after the above detection to take corrective actions for avoiding stall or surge.

The reduction of the risk of compressor stall and compressor surge is a further reason for the prior art compressor control systems to operate with the high safety margin.

SUMMARY OF THE INVENTION

It is an object of the present invention to provide a process for monitoring of an axial compressor which is sensitive in detecting small changes in the flow conditions of the axial compressor near the maximum mass flow rate.

It is a further object of the invention to provide a process for monitoring of an axial compressor which provides for an early warning of a compressor stall.

Another object of the invention is to provide a process for monitoring of an axial compressor allowing an online monitoring with fast response, using common calculation techniques for the signal evaluation.

One or more of these objects are solved by the process according to the invention, said process comprising the following steps:

a) measuring of pressure fluctuations within at least one of said compressor stages in the region of said housing by means of at least one pressure sensing device, each device delivering a sensor signal, respectively;

b) deriving a frequency signal from each of said sensor signals, said frequency signal being indicative of amplitudes of frequency components of said respective sensor signals in a respective frequency interval;

c) checking whether each of said frequency signals comprises at least one characteristic peak in a region of a characteristic frequency assigned to one of said compressor stages, respectively and determining at least one peak parameter indicative of the form of said characteristic peaks, said characteristic frequency being defined as the product of said rotational speed and the blade number of the rotor blades of the respective compressor stage;

d) generating a status change signal indicative of a change of operational status of said compressor in case of said peak parameter having a value lying beyond a determined value range.

According to the invention the characteristic peak is observed. This peak is sensitive to changes in the flow conditions near the maximum available mass flow rate. When the compressor is operating in a status characterized by a substantial distance from the maximum flow rate the wake regions of the rotating blades passing the pressure sensing device produce a pressure variation at that sensing device with the characteristic frequency. The frequency signal derived from the respective sensor signal shows a respective characteristic peak the form of which is defined by respective peak parameters (peak height, peak width or the like). It has been found that, with increasing load approaching the mentioned maximum mass flow rate for the respective rotor frequency, the characteristic peak becomes more distinct (increasing height and/or increasing width) which may be attributed to the wake regions increasing with load. However, with further increasing load a decreasing characteristic peak is observed. This phenomenon is due to the separation of the region of the flow boundary layer in the area of the downstream edge of each blade into fragments called "flow boundary layer parts" these boundary layer parts being collected at the inner circumferential surface of the compressor, constituting a relatively thick layer with stochastic fluctuations. The pressure sensing device sensing the pressure fluctuations of this layer at the inner circumferential surface of the compressor delivers a sensor signal with increasing amount of background noise component and reduced periodic part component. Thus, in the above mentioned separated flow pre-stall condition, the characteristic peak decreases and in general vanishes since the stochastic fluctuating layer at the inner circumference of the compressor increases and shields the pressure sensing device against the periodic pressure fluctuations due to the rotating wake regions of the rotating blades. In the pre-stall status there is essentially no blockage of the stage. Only with further increasing load the pre-stall status evolves into a stall status (rotating stall; part span stall; full span stall; compressor surge).

It can be demonstrated that, when using a conventional gas turbine (such as General Electric LM 5000) as part of a power plant, the first signs of a compressor full stall leading to a later shutdown of a gas turbine can be identified by observing the characteristic peak more than half an hour before the actual shutdown. Within this context, the invention provides for an early warning of a stall condition so that appropriate measures to avoid engine stall can be undertaken.

The frequency signal may easily be derived from the detector signals by using common evaluation techniques, for example fast Fourier transformation (FFT) or fast Hartley transformation (FHT). No model calculations are necessary.

The pressure fluctuations due to the wake regions of the rotating blades can best be measured by said pressure sensing device being arranged at said housing between the rotor blades and the stator blades of the respective compressor stage.

The frequency may be obtained by fast Fourier transformation, the respective electronic transformation units being readily obtainable. For the process according to the invention only the time varying part of the absolute pressure is of interest. These pressure fluctuations may be directly measured by means of a piezoelectric, a piezoresistive pressure sensor or especially a piezocapacitive pressure sensor. Another less preferred pressure sensing device is a strain gauge pressure sensor.

The peak parameter indicative of the form of the characteristic peak may be the peak height or the peak width. In both cases, the parameter is easy to determine and easy to be compared with a limit value or with the limits of an allowed region.

In order to enhance the accuracy and/or to reduce the evaluation efforts, the frequency interval in which the frequency signal has to be evaluated, is determined to have a reduced width of less than 4000 Hz. A preferred width is 2000 Hz so that the frequency signal has to be determined only between the characteristic frequency minus 1000 Hz and the characteristic frequency plus 1000 Hz.

It was found out that the observation of two characteristic peaks assigned to two different stages of the compressor enhances the sensitivity of the monitoring process. At high compressor rotational speed, the loading on the stages increases with the pressure level delivered by the stage; the stage at the high pressure axial end are subjected to the highest load at high speed. When the compressor is driven in a region near the maximum possible load, the last stage usually is in the separation flow pre-stall condition, so that the corresponding characteristic peak is very small or is hidden by the background signal. Depending on the actual fluid flow status of the compressor, the characteristic peak in next to the last stage may decrease with increasing load in contrast to the second to the last stage in which the characteristic peak may rise with load. This is due to the growing tendency of separation in the next to the last stage and the increase of the wake regions in the second to the last stage. Thus, the form of the characteristic peak in the mentioned two stages is in opposite direction such that also small changes in the fluid flow status can be detected.

Preferably said peak parameter is defined as a rated sum of individual peak parameters of each of said at least two different characteristic peaks, said individual peak parameters being determined by the peak shape of the respective characteristic peak. In this way, only one parameter is to be observed.

In case of the above described three compressor stages with opposite dependency of the characteristic peak in the next to the last and second to the last stage, this rated sum may be defined as the sum of the reciprocal of the peak height of the characteristic peak assigned to the last pressure stage, the reciprocal of the peak height of the characteristic peak assigned to the next to the last pressure stage and the peak height of the characteristic peak assigned to the second to the last pressure stage.

When the compressor is operating well below its maximum rotational speed, the pressure fluctuations in the front stages can be observed in the described way (observing the changes of the form of the respective characteristic peak) in order to determine the status of the system. For lower speeds and high load the mentioned separation and stall effects are primarily observed in the front stages. However, the full speed mode of the compressor, in most of the cases, is more important due to the better economical performance.

The frequency signal derived form the sensor signal of a single sensor generally exhibits not only the characteristic peak of the stage in the pressure sensing device as located, but also the characteristic peaks of stages which are located upstream due to the movement of the pressure waves through the compressor. However, the amplitude of the characteristic peak decreases with distance to the pressure sensing device so that in some cases it is more advantageous to use a separate pressure sensing device for each stage (and characteristic peak) which is of interest. In both cases, the characteristic peaks of measuring stages may be easily differentiated since, in general, the number of rotor blades and thus the characteristic frequency is different.

The invention relates further to a process for controlling of an axial compressor, which is based on the above described process for monitoring of an axial compressor with the additional feature that a status change signal, derived from said process, is used for controlling said axial compressor. Depending on the special construction of the compressor and on the operational parameters, especially the rotational speed of the compressor, at least one of the stages (in general the last stage at the high-pressure end of the compressor) is in the separation flow pre-stall status (with the compressor being driven at maximum efficiency, that is near the upper limit of its mass flow rate).

When the actual performance of the compressor changes in a direction away from the maximum possible mass flow rate, the separation effect decreases and is accompanied by a corresponding increase of the characteristic peak for a specific stage. This increase may be used as an input for controlling the axial compressor in a way to increase the compressor load. In a similar manner, a decrease of the characteristic peak may be used for controlling the axial compressor in a way to decrease the compressor load with increasing load, the characteristic peak in the second to the last stage first increases with a growth of the wake regions and then decreases with the beginning of the flow separation (pre-stall status). The monitoring of this tendency may serve as a basis for control of the compressor in the sense of avoiding an overload of the compressor—avoiding both compressor stall and compressor surge conditions while not operating the compressor in an uneconomical way too far below the optimum mass flow rate.

To facilitate the simultaneous observation of changes of several characteristic peaks, it is preferred to define a peak parameter as a rated sum of individual peak parameters of each of said characteristic peaks.

The invention further relates to a device for monitoring of an axial compressor in accordance with the above-described process for the monitoring of an axial compressor. The invention also relates to a device for controlling an axial compressor in accordance with the above mentioned process for controlling an axial processor.

BRIEF DESCRIPTION OF THE DRAWINGS,

For a better understanding of the invention, reference is made to the following description and the drawings.

Figure 4:
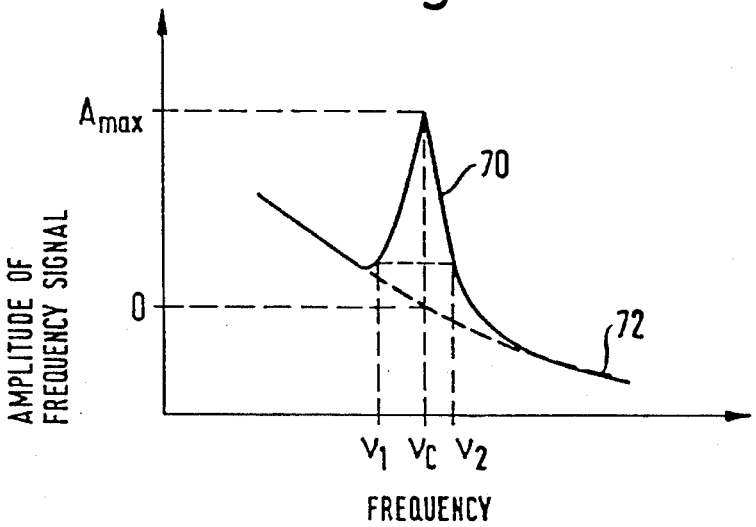
FIG. 4 illustrates a frequency signal with a characteristic peak.

FIGS. *5a,b,c,* show three successive forms of the characteristic peak of FIG. 4 obtained by increasing the load starting with FIG. *5a;*

Figure 6:
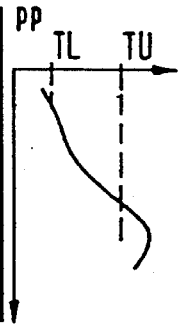

FIG. 6 is a table for demonstrating the dependency of the form of the characteristic peaks of the three last stages on load.

Figure 7:
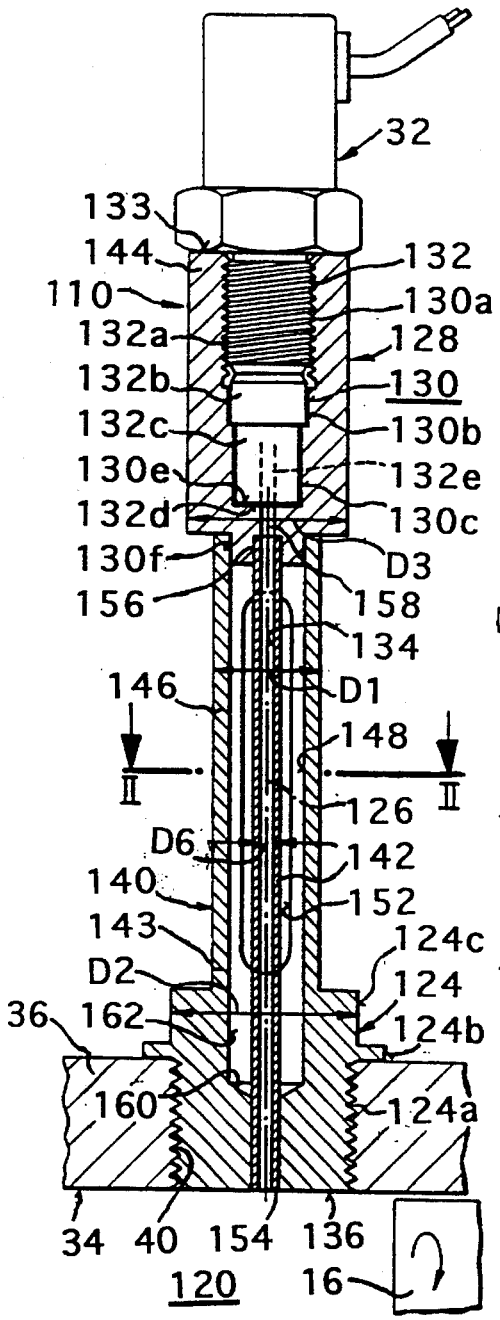
Figure 8:
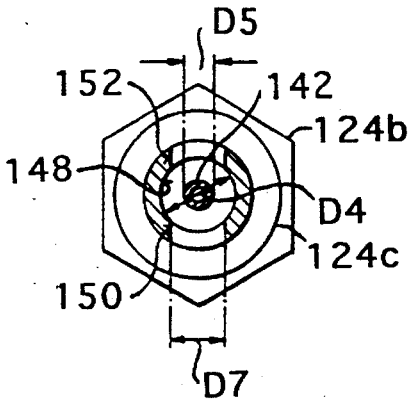
Figure 9:
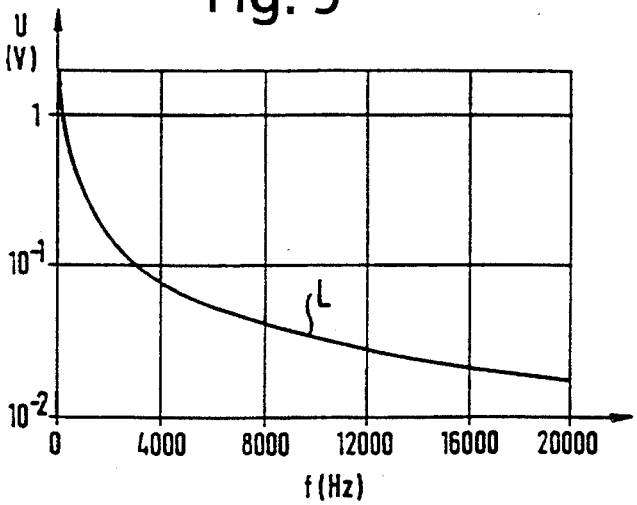

FIG. 7 is an axial cross-sectional view of an adaptor according to the invention, mounted to a gas turbine wall;

FIG. 8 is a radial cross section of the adaptor as viewed along lines II—II in FIG. 7, and FIG. 9 is a graph showing the dependency of a sensor signal with the frequency of the pressure variations to be measured.

DESCRIPTION OF THE PREFERRED EMBODIMENT

Figure 1:
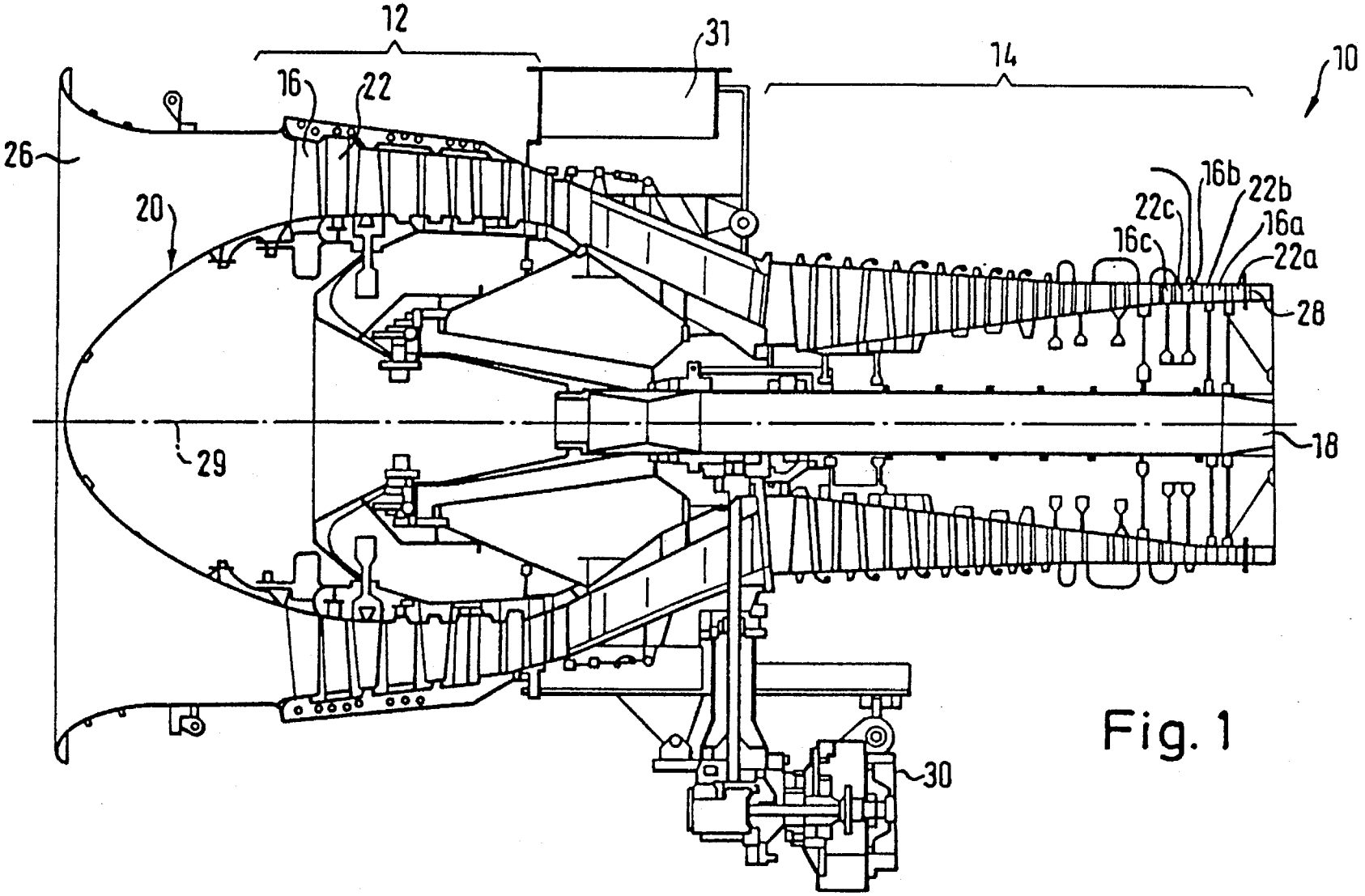
FIG. 1 is a simplified graphic representation of an axial compressor as part of a gas turbine showing the location of dynamic pressure probes.
Figure 2:
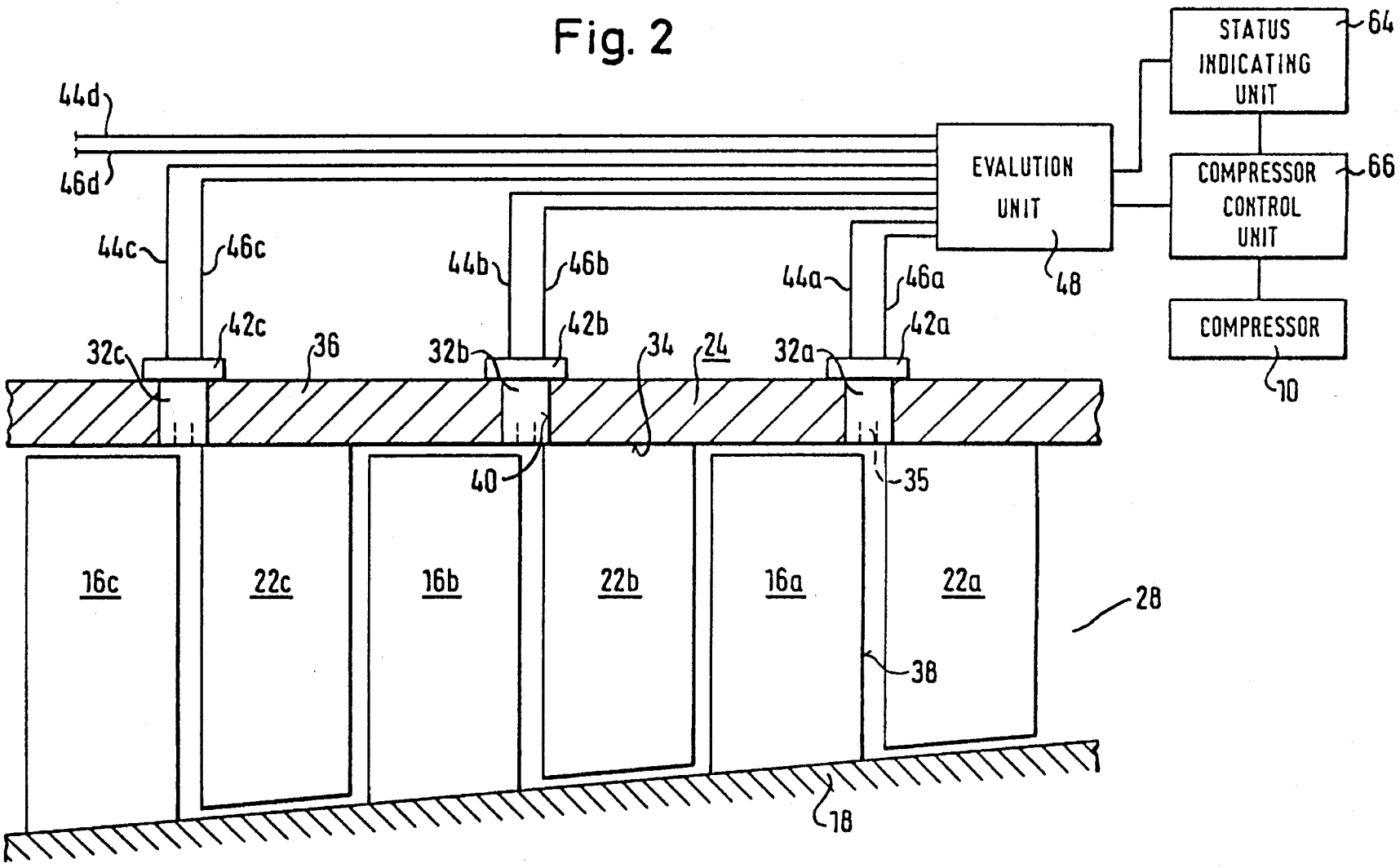
FIG. 2 is a schematic representation of the compressor of FIG. 1 illustrating the three final compressor stages at the high pressure end of the compressor.

Referring to the drawings, wherein equal numerals correspond to equal elements throughout, first reference is made to FIGS. 1 and 2 wherein a typical compressor part of a gas turbine engine is depicted (including the present invention). The compressor 10 is comprised of a low pressure part 12 and a high pressure part 14. Rotor blades 16 of the compressor are mounted on a shaft 18 of a rotor 20. Stator blades 22 (guide vanes) are mounted in a housing (casing) 24 of said compressor 10 and are therefore stationary. Air enters at an inlet 26 of the gas turbine engine and is transported axially to compressor stages of the compressor under increasing pressure to an outlet 28. An axis 30 of said compressor is defined as the axis of rotation of the rotor 20. Although not shown, the present invention may also be employed in connection with a radial type compressor.

Each of the mentioned compressor stages consists of two rows of blades with equal blade number, namely a row of rotor blades 16 and a row of stator blades 22. The blades of each row are arranged one following the other in a circumferential direction with respect to said axis 29. FIG. 2 shows the last stage of the compressor at its outlet 28 (high pressure axial end of the compressor) with rotor blades 16*a* and stator blades 22*a*. Also, the second to last and the third to the last compressor stages are depicted with rotor blades 16*b* and stator blades 22*b* and rotor blades 16*c* and stator blades 22*c*, respectively.

The compressor 10, according to FIG. 1, comprises an accessory gear box 30 enabling the adjustment of orientation of blades in order to change the load of the respective stages. FIG. 1 further shows a bleed air collector 31 between the low pressure part 12 and the high pressure part 14. As the compressor, used in connection with the invention, is of common construction, it is not necessary to go into further detail.

According to the invention, several pressure sensing devices in form of dynamic pressure sensors, are mounted in the axial gaps between rotor blades 16 and stator blades 22 of stages of the high pressure part 14 of compressor 10. According to the most preferred embodiment, shown in FIGS. 1 and 2, these dynamic pressure sensors are mounted in the last three stages nearest the outlet 28 of the compressor 10. The dynamic pressure sensor associated to the last stage is indicated with 32*a* and the following dynamic pressure sensors (in the downstream direction of the compressor 10) with 32*b* and 32*c*. An inlet opening 35 of each sensor 32 is flush with an inner circumferential face 34 of a wall 36 defining said housing 24. In this way, each sensor 32 measures the pressure fluctuations of the respective stage, occurring at the inner circumferential face 34. Since the respective sensor 32 is located in the region of the axial gap between the rows of rotor blades 16 and stator blades 22, following the rotor blades downstream, each sensor is sensitive for the so called wake regions (Dellenregions) being developed by the axial air flow at the downstream edge 38 of each rotary blade. These wake regions rotating with the respective rotary blade 16 are regions with lower density and flow velocity and with varying flow direction. Instead of directly mounting the respective sensor 32 in an opening 40 (borescope hole), it is also possible to use an elongated adaptor discussed and shown with respect to FIG. 7, FIG. 8, and FIG. 9 which, with one of its ends, is mounted to the opening 40 and, at its other end, carries the sensor.

Figure 3:
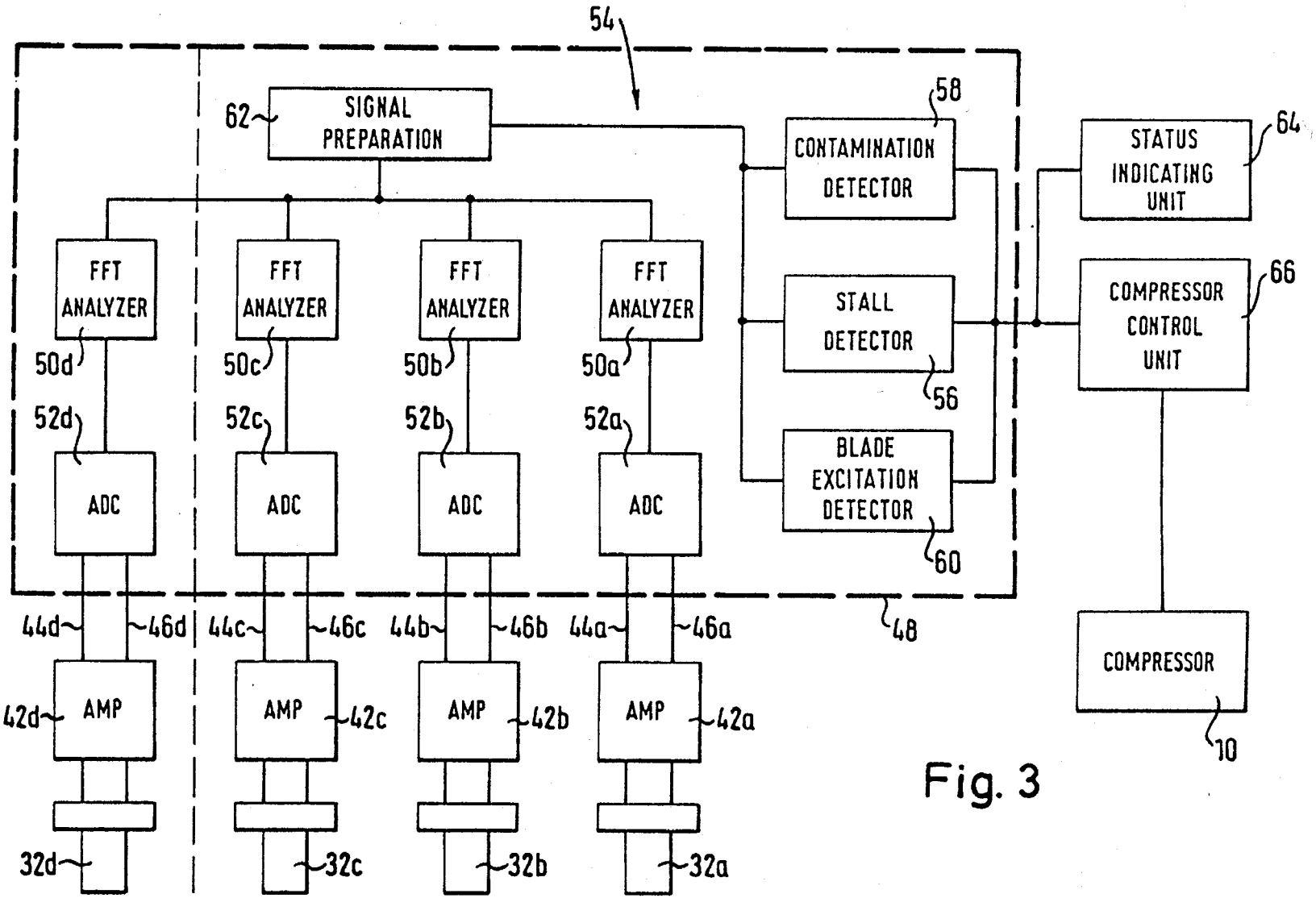
FIG. 3 is a block diagram of the dynamic pressure probes connected to an evaluation unit.

The illustrated location of the sensor 32 at the high-pressure axial end of the high pressure part 14 of the compressor 10 is preferred for a compressor operating at high speed (design speed). For lower speeds or for changing operational conditions, pressure sensors may be mounted in the axial gaps between "rotor" and stator blades at the other axial end of the high pressure part 14 of compressor 10. Also, more than three sensors may be employed, as shown in FIG. 3, with a fourth sensor 32*d*. The minimum is one sensor. Dynamic pressure sensors, preferably piezoelectric pressure sensors, are used because of their reliability, high temperature operability and sensitivity for high frequency pressure fluctuations up to 20000 Hz (for example Kistler Pressure Sensor, Type 6031).

As shown in FIGS. 2 and 3, each sensor is provided with an amplifier 42, amplifying the respective sensor signal. These amplifiers 42 are connected via lines 44,46 to an evaluation unit 48.

As shown in FIG. 3, the evaluation unit 48 contains several Fast Fourier Transformer (FFT) analyzers 50 which respectively receive signals from the mentioned amplifier 42*a*–42*d* through analogue digital converters ADC (or multiplexers) 52*a*–*d* which are connected between each of the respective amplifiers (AMP) 42*a*–*d* and FFT analyzers 50*a*–*d*.

The signals from the FFT analyzers 50*a*–*d* are transmitted to a computer unit 54 comprising several subunits, amongst them a stall detector 56, the functioning of which is described above. Besides this stall detector 56, further detectors for the status of the compressor may be installed, for example a contamination detector 58 for detecting fouling of the blades of the low pressure part 12 of compressor 10 and a blade excitation detector 60 for detecting pressure fluctuations which are able to induce high amplitude blade vibrations, which vibrations may damage the compressor. However, the stall detection according to the present invention, may also be performed independently of contamination detection and blade excitation detection.

In order to facilitate the computing of the frequency signals outputted from the FFT analyzers 50*a*–*d*, a unit 62 for signal preparation may be connected between the FFT analyzers 50*a*–*d* and the detectors 6,58,60. The unit 62 contains filter algorithms for handling and smoothing raw digital data as received from the FFT analyzers. A control program periodically switches the sensor signals of each of the individual dynamic pressure sensors 42*a*–*d* via the ADC-52*a*–*d* to the FFT analyzers 50*a*–*d*. The resulting frequency signals from the FFT analyzers, after smoothing via unit 62, are forwarded to said detectors 56,58,60 for comparison with respective reference patterns. If the comparison analysis indicates deviations beyond a predetermined allowable threshold of difference, the computed evaluation is transmitted to a status indicating unit 64 to indicate contamination or stall or blade excitation. Thus, the operation and status of compressor 10 can be monitored. Independent of this monitoring, it is further possible to use the computed evaluation for controlling purposes. A respective compressor control unit 66, connected to evaluation unit 48, is also shown in FIG. 3 serving for controlling the compressor 10. In case of an unnormal status of the compressor, detected by one of the detectors 56,58,60, the compressor control unit 66 takes measures to avoid the risk of damaging compressor 10, for example by lowering the load (adjustment of orientation of blades by means of gear box 30 or by reducing the fuel injection rate in the combustion section.). In some instances, the compressor control unit 66 may stop the compressor 10.

A general parts and components list for making, installing, and using the present invention is presented in Table 1. The vendor identifier in Table 1 references the information given in Table 2, which identifies the vendor's address for each vendor identifier.

TABLE 1

| Description | | Vendor |
|---|---|---|
| Dyn.press sensor | 6031 | KIST |
| Dyn.press sensor | 6001 | KIST |
| Mounting nuts and conn.nipples | 6421 | KIST |
| Mounting nuts and conn.nipples | 6421 | KIST |

TABLE 1-continued

| Description | | Vendor |
|---|---|---|
| Mounting nuts | 6423 | KIST |
| Kable | 1951A0.4 | KIST |
| Kable | 1631C10 | KIST |
| Amplifier | Y5007 | KIST |
| Isolation transformer | T4948 | HAUF |
| Multipair twistet cable | | |
| Vibration pick up | 306A06 | PCB |
| Kable | 1631C10 | KIST |
| Transducer 12 channel | F483B03 | PCB |
| CRF-Vib signal 0–10 V | | VIBR |
| Low press Rotor speed | | GE |
| High press Rotor speed | | GE |
| Isolation Aplifier | EMA U-U | WEID |
| Centronics connector | | |
| Relay | 116776 | WEID |
| Industrial computer | BC24 | ACTI |
| CPU 80386/20 Mhz | | |
| Math coprocessor 80387 | | |
| RAM = 1 MB | | |
| 20MB HD | | |
| EGA | | |
| Power supply 28 V DC | | |
| 5 free 16 Bit Slots/AT-Bus | | |
| DOW 3.3 | | |
| Spectral Analyser | V5.x | STAC |
| LAN Network board | 3C501 | 3COM |
| 2 MB RAM/ROM Board | | DIGI |
| EGA Monitor 14" | | |
| Keybord for AT-PC | | |
| Instrument Rack | | KNUR |
| VMS Operating System | | DEC |
| Operator Interface and General Purpose Computer | | |
| Microvax II Computer with 9MB, RAM, hard disk drive of 650 megabytes storage capacity | | DEC |
| TEK H207 monitor | | TEK |

TABLE 2

| Vendor | Address |
|---|---|
| ACTI | ACTION Instruments, Inc.<br>8601 Aero Drive<br>San Diego<br>CA 92123 USA |
| DIGI | Digitec Engineering GmbH<br>D-4005 Meerbusch, Germany |
| GE | General Electric Co.<br>1 Neumann Way<br>Mail Drop N-155<br>US Cincinnati OHIO |
| KIST | Kistler Instrumente GmbH<br>Friedrich-List-Strasse 29<br>D-73760 Ostfildern, Germany |
| KNUR | Knuerr AG<br>Schatzbogen 29<br>D-8000 Meunchen 82, Germany |
| PCB | PCB Piezotronics Inc.<br>3425 Walden Avenue<br>Depew<br>New York |
| VIBR | Vibro meter SA<br>Post Box 1071<br>CH-1701 Fribourg, Germany |
| WEID | Weidmueller GmbH & Co.<br>PF 3030<br>D-4930 Detmold, Germany |
| DEC | DIGITAL Equipment Corp.<br>Maymond, Massachusetts |
| TEK | Tektronics Corp.<br>P.O. Box 1000<br>Wilsonville, Oregon 97070-1000 |

In the detectors 56, 58, 60, the smoothed frequency signal is evaluated, said frequency signal being indicative of the amplitudes of frequency components of the respective sensor signal in a respective frequency interval.

The stall detector 56 examines the frequency signals in a specific frequency region around a specific frequency, the so called characteristic frequency C, said frequency C being defined as the product of the present rotational speed n of rotor 20 and the blade number z of the rotor blades of the respective compressor stage:

$$C=n*z \tag{1}$$

The frequency interval around C may have a width of less than 4000 Hz and preferably is 2000 Hz so that the upper limit LL may be C+1000 Hz and the lower limit LL may be C–1000 Hz (see FIG. 5). In general, the blade number of rotor blades equals the blade number of stator blades within the same stage.

Figure 5A:
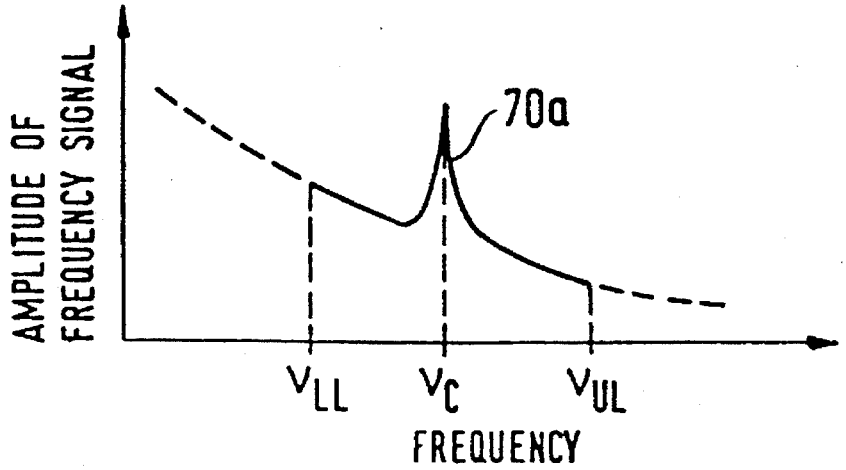
Figure 5B:
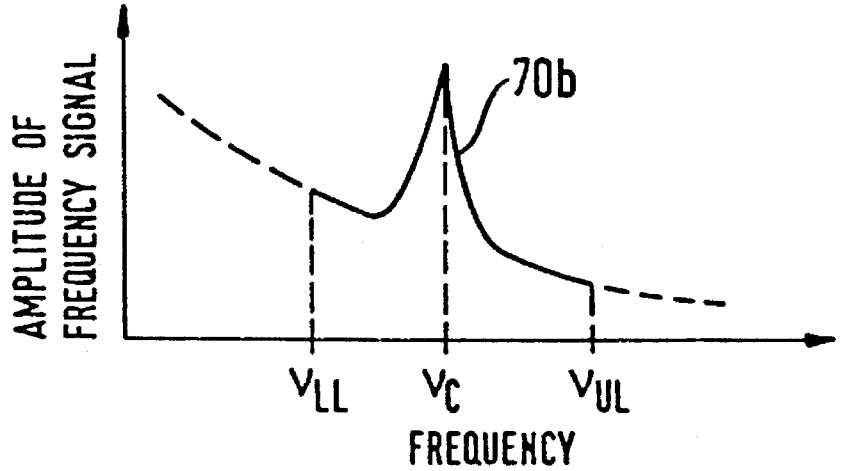

The wake regions rotating with rotor blades 16 of the respective compressor stage pass the sensor 32 with a characteristic frequency C. In FIG. 4, the frequency signal shows a respective characteristic peak 70 at Vc. It has been found that the form of this characteristic peak varies in a characteristic manner, if the load of the respective stage is increased starting from a normal stage load with peak 70*a* shown in FIG. 5A. In a first phase, the peak becomes more characteristic as shown in FIG. 5B (peak 70*b*). Both the height and the width of the characteristic peak increase as the load increases. This behavior is due to an increase of the wake regions (Dellenregionen) of the rotating blades, producing more characteristic pressure variations with the characteristic frequency at the location of the respective sensor 32.

Figure 5C:
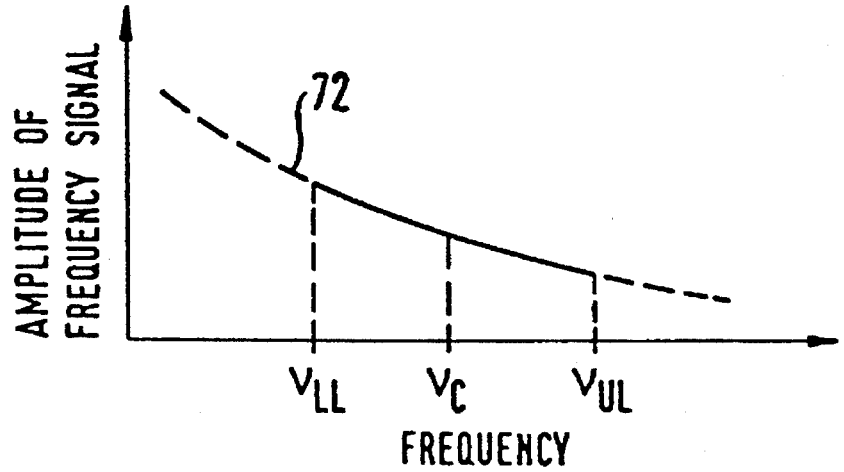

However, with further increasing load, the peak height rapidly decreases and the peak is covered by the sloped background line 72. This behavior is due to the separation of parts of the boundary layers of the rotating blades 16. These separated parts of the boundary layers are moved radially outwards to the inner circumferential face 34 of the housing 24 under the influence of rotational forces exerted by the rotor 20. Here, the swirled separated regions are collected to form a relatively thick layer with stochastic fluctuations. This layer shields sensor 32 from the pressure fluctuations of the wake regions so that the characteristic peak measured by this sensor decreases rapidly and is covered by the background line 72. This separation phase may be called separated flow pre-stall phase since the separation of boundary layers and the collection of separated flow regions at the inner circumferential face 34 does not remarkably reduce the pressure ratio of the respective stage. Stall effects (rotating stall) with microscopic areas (bubbles), and some associated blockage of compressor throughput, will be observed when the characteristic peak has vanished (FIG. 5*c*).

The observation of the characteristic peak therefore is a sensitive tool for monitoring and/or controlling of a compressor. One possibility of detecting changes of the form of the characteristic peak 70 would be a comparison of a predetermined peak form by means of pattern recognition. However, the evaluation is simplified, if not the complete peak form, but only one peak parameter is being observed and compared with limit values. This peak parameter may be defined as the peak height Amax above the background line 72 or the peak width 2–1 as shown in FIG. 4.

For a sensitive monitoring or controlling of the compressor, several characteristic peaks of different stages may be observed. In a most preferred embodiment, designed for monitoring and/or controlling of the compressor at design speed, the characteristic peaks of the last three stages of the high pressure part 14 are observed. In the present embodiment, the last stage is the 13th stage so that the respective peak parameter (especially peak height) is called p13. Consequently, the other two peak parameters are called p12 and p11. The table in FIG. 6 indicates the behaviors of the peak parameters p13, p12 and p11 with increasing load, wherein the upwardly oriented arrows indicate increasing and the downwardly oriented arrows indicate decreasing load and peak height, respectively with the number of arrows indicating the respective strength. The column at the utmost right is called "stall level", said stall level (general peak parameter) being expressed by the following formula:

$$SL=\frac{a}{p13}+\frac{b}{p12}+c*p11 \tag{2}$$

Experiments, performed with a compressor of a gas turbine of type LM 5000, show that, in the last compressor stage, separation is present at almost all times if the gas turbine is operated at its full speed operation mode under normal flow conditions. The load L2 of the respective stages in this case is indicated in line 2 of FIG. 6. However, when lowering the load to a value L1 (Line 1 in FIG. 6), the separation in stage 13 vanishes so that the characteristic peak develops, starting from FIG. 5*c* to characteristic peak forms 70*b* in FIG. 5*b* and proceeding to 70*a* in FIG. 5*a*. This behavior is indicated by two upwardly directed arrows on FIG. 6. At the same time, the characteristic peak in stage 12 decreases from peak form 70*b* to peak form 70*a* (FIGS. 5B and 5A). The peak form 70*a* of the 11th stage remains unchanged. The above mentioned peak parameter SL according to equation 2 decreases with decreasing load from L2 to L1 since coefficient a is larger than coefficient b so that the contribution of the reciprocal value A/p13 exceeds the contribution of the reciprocal value B/p12.

On the other hand, when increasing the load from the normal value L2 to a value L3, the characteristic peak of stage 13 is unchanged (form according to FIG. 5*c*); the characteristic peak of stage 12 develops from FIG. 5*b* to 5*c* and the characteristic peak of stage 11 develops from FIG. 5*a* to 5*b*. In dependence on parameters A, B, C, the peak parameter more or less sharply increases as shown in FIG. 6, right hand side.

Upon further increasing load to value L4, characteristic peaks of stages 12 and 13 remain unchanged (FIG. 5*c*), whereas the characteristic peak of stage 11 changes from FIG. 5*b* to FIG. 5*c*. Consequently, the peak parameter decreases.

In dependence upon the operation mode and compressor type used, the risk of compressor stall or compressor surge is usually negligible with loads L1 and L2, comparatively low with load L3, and high with load L4. Therefore, a monitoring or controlling of the compressor to avoid the risk of stall or surge is possible by observing parameter SL and outputting an alarm signal if a certain upper threshold value TU is exceeded by the actual peak parameter SL. In order to avoid operation of the compressor in an uneconomic way below the maximum possible load value, a low threshold value TL could be defined by delivering an alarm signal if the actual peak parameter value SL becomes lower than TL. In both cases, evaluation unit 48, according to FIGS. 2 and 3, delivers the respective alarm signal to the status indicating unit 64 for informing the service staff appropriately.

The peak parameter SL may also be used for closed-loop-control of the compressor. If the measured peak parameter SL leaves the allowed region between the lower threshold TL and the upper threshold TU, the compressor control unit receives the respective control signal in order to change one or more operational parameters of the compressor to change the load of the compressor into the desired direction.

By using equation 2 accordingly, load L4 is avoided, meaning a separation effect in stage 11 is avoided, since then stall is expected to occur. The stability limit therefore lies between load L3 and load L4.

However, if the stability limit is only reached after the separation has started in stage 13 (load L4), the following equation (3) for the peak parameter is preferred:

$$PP=\frac{A}{p13}+\frac{B}{p12}+\frac{C}{P11} \tag{3}$$

Since the characteristic peaks increase in importance from stage 13 to stage 11, coefficient C is chosen to be larger than coefficient B and coefficient B is chosen to be larger than coefficient A. The discussion respecting in FIG. 7, 8, and 9 presents a detailed description of the adaptor for the preferred pressure measuring system used in the present invention.

The invention relates to an adaptor for mounting a gas pressure sensor to a wall of a housing of a high temperature system, such as a gas turbine or a chemical reactor, for example plug flow reactor.

The elongated sensor carrier provides for the necessary temperature gradient between the hot wall at one end of said carrier means and the pressure sensor at the other end thereof. The tube means connecting the interior of the housing with the pressure sensor has a well-defined, frequency-dependent flow resistance for the gas flow through the tube means. Therefore, accurate and reliable pressure measurements can be performed. The tube means are ready available with high precision inner surface required for well-defined flow resistance. Thin-walled tube means may be used since the mechanical stability of the adaptor is provided by the separate sensor carrier means. By choosing a tube means with tube means length and tube means diameter being determined such that only a very small fluid volume is defined within the adaptor, high frequency pressure variations within housing with frequencies up to 10,000 Hz and higher may be detected by the pressure sensor.

In a preferred embodiment the carrier means comprises at said one end thereof a first threaded end portion to be secured in the hole of the wall, for example in a borescope hole of a gas turbine wall, said tube means being fastened to said first end portion in the region of said one end of said tube means. Thus, the common borescope holes of the gas turbine can be used for mounting the pressure sensor. No further holes have to be drilled into the gas turbine wall.

Said carrier means may comprise at said other end thereof a second end portion provided with said recess, said tube means being fastened to said second end portion in the region of said other end of said tube means. In this way, most of the length of the carrier means between said first and said second end thereof is used for producing the temperature gradient. This ensures a relatively compact construction.

Furthermore, said carrier means may comprise a middle portion connecting said first and said second end portion, said middle portion having no direct contact with said tube means. This separation of tube means and carrier means ensures rapid cooling, especially when using a preferred embodiment of the invention, wherein said middle portion is formed by a hollow cylindrical shaft having a cylinder axis extending along said axis of elongation, said tube means extending through said middle portion along said cylinder axis with clear distance between said tube means and said shaft. The hollow cylindrical space between said tube means and said wall provides for additional cooling especially in case of said shaft being provided with at least one hole for allowing entrance and exit of cooling fluid to the outer surface of said tube means.

For rapid cooling, it is possible to circulate cooling gas or cooling liquid through said hollow cylindrical space. However, if at least two elongated holes are provided, each with an axis of elongation extending parallel to the cylinder axis, the cooling by air entering into and exiting from the respective one of the two elongated holes, may suffice. The regular cooling air for cooling the housing of high temperature systems, for example the gas turbine wall, may also be used for cooling the adaptor without additional measures.

An outer diameter of said hollow cylindrical shaft may not be greater than two thirds of an outer diameter of said second end portion in order to obtain a high temperature gradient since less raw material is used. Furthermore, the mounting space needed for the adaptor is reduced which is important, since at the outside of the gas turbine wall there is an actuator system with many rods for actuating turbine elements, especially turbine blades.

In order to facilitate the mounting of the adaptor, said first end portion is provided with a polygonal section for engagement with a screwing tool.

Said carrier means and said tube means may comprise steel alloy parts having high mechanical strength and high temperature resistance.

The best results were obtained with V4A-steel alloy. This material has nearly the same thermal expansion coefficient as the commonly used material of the gas turbine wall, so that leakage problems due to different thermal expansion are avoided.

Preferred dimensions of the tube means are an inner diameter between 0.4 mm and 1.2 mm and a tube length between 20 mm and 100 mm. The best results are obtained with an inner diameter of approximately 1 mm and a tube length of approximately 50 mm.

It was found that the ratio of the tube length value of the tube means and the value of the inner diameter of the tube means are decisive for the transmission characteristics of the tube for high frequency pressure variations. Tubes with the same ratio essentially exhibit the same transmission characteristics. Good results were obtained with a ratio between 20 and 80. Best results were obtained with a ratio of approximately 50.

In order to obtain a high temperature resistance with sufficient mechanical strength of the tube, the thickness of the tube wall should be between 0.2 and 0.8 mm.

The transmission characteristics of the adaptor, that is the attenuation of the sensor signal with increasing frequency of the pressure variations with constant amplitude may be determined experimentally by means of a calibrating device. For this aim, the adaptor may be mounted to a reference pressure source with a variable pressure pulse frequency.

It was found that the transmission characteristics of the tube means may be approximated by the following formula for the ratio of the absolute pressure P2 at the other end of the tube means and the absolute pressure P1 at the one end of the tube means:

$$P2/P1=a*f^{b}*e^{f*c}$$

with the pressure P1 at the one end of said tube means varying with a frequency f [Hz] and constants a, b and c depending on the dimensions of the tube means.

A set of parameters a, b, c may be determined for a given ratio of the value of the tube length and the value of the inner diameter by theoretical calculation or by using the aforementioned calibrating method. To determine the set of parameters, only a small sample of measurements, at least three measurements at three different frequencies, have to be performed. After determination of the set of parameters for a given ratio, the transmission characteristics of tube means with this ratio, but with different length and diameter, may be described by the above formula.

For a ratio of the value of the tube means length and the value of the inner diameter of approximately 50, the set of parameters shows the following values: a=0.416; b=−0.003; c=−0.000186.

The invention relates further to a pressure sensing device for measuring dynamic pressure variations within a gas turbine, comprising an adaptor as described above and a piezoelectric or piezoresistive pressure sensor mounted to said adaptor. Piezoelectric and piezoresistive pressure sensors generally are only operable at relatively low temperatures. On the other hand, piezoelectric and piezoresistive pressure sensors produce signals representing only the dynamic part of the pressure within the gas turbine. For many diagnoses and monitoring methods this dynamic pressure part is of main interest. Therefore, the pressure sensing device as mentioned before, is advantageous for these applications.

Referring to the drawings, wherein equal numerals correspond to equal elements throughout, first, reference is made to FIG. 7, wherein an adaptor 110 equipped with a pressure sensor 32 is mounted to a wall 36 of a gas turbine. The wall 36 is partly broken. The lower side 34 in FIG. 7 of wall 36 defines an interior (inner) space 120 of the gas turbine, in which inner space a gas turbine rotor with blades 16 (in FIG. 7 partly shown) is rotating. The rotating blades 16 are cooperating with not shown static blades mounted to the wall 36. The adaptor 110 is preferably mounted in the region of the gap between stator blades and rotor blades of one stage of the gas turbine.

It is not necessary to drill a hole into wall 36 for mounting the pressure sensor because the pressure sensor may be mounted to the known borescope holes 40 which are used for visual inspection of the interior of the gas turbine by an endoscope device.

For this purpose, the adaptor 110 is provided with a threaded end portion 124 with a screwed section **124*a* to be screwed into the borescope hole 40. The first end portion 124 is further provided with a polygonal section 124*b* which is also shown in FIG. 8. To assure stability of the end portion 124, the polygonal section 124*b* is followed by a cylindrical section 124*c***.

The adaptor 110 is elongated with an axis of elongation 126 extending between the mentioned first end portion 124 and a second end portion 128. The axis of elongation 126 coincides with the axis of the borescope hole 40. Said second end portion 128 is provided with a recess 130 for sealingly receiving a sensor head 132 of said pressure sensor 32. Said recess 130 is arranged concentrically to said axis of elongation 126 and opens into the radial end face 133 of the second end portion 128. Starting from said opening, said recess is formed by a threaded section **130*a* for receiving the correspondingly threaded section 132*a* of said sensor head 132. The threaded section 130*a* is followed by two stepped cylindrical sections 130*b* and 130*c* for receiving corresponding cylindrical sections 132*b* and 132*c* of the sensor head 132**.

At the radial end face **132*d* of the sensor head, a central opening 132*e* for entrance of pressure fluid into the sensor head, is indicated by dashed lines in FIG. 7. A central fluid channel 134 of said adaptor 110**, extending along said axis 126 between a radial end face 136 of the first end portion 124 and a radial end face 130*e* of said recess 130 opens into the recess 130 adjacent said hole 132*e* of the sensor 32. The sensor head is fitted into said recess 130 with only very small distance or clearance between said recess 130 and said sensor head so that there is only a very small (lost) volume of pressure fluid to enter into said space between sensor head 132 and recess 130. In case of the thermal expansion coefficients of the pressure head and of the material of the adaptor 110 being almost identical, it is also possible to fit said pressure head into said recess 130 with almost no clearance between the circumferential faces and the radial end faces 130*e*, 132*d* to further reduce the lost volume of pressure fluid. A very small lost volume is necessary for enabling the measurement of very high frequent pressure variations. A larger lost volume would dampen high frequency pressure variations.

The sensor 32 is sealingly mounted to adaptor 110 in the usual manner, either by employing rubber-sealing rings or metallic-sealing rings (not shown) or by using sealing edges.

The adaptor 110 consists of two main parts, namely a carrier means generally designated with numeral 140 and tube means in the shape of a single tube 142. The carrier means 140 may be of one-part construction or of the shown two-part construction with a lower part 143 and an upper part 144. The lower part 143 consists of the above-mentioned first end portion 124 and a middle portion 146 with reduced outer diameter D1 (8 mm) as compared to the outer diameter D2 (14 mm) of the cylindrical section 124*c* of the first end portion 124 and also with respect to the outer diameter D3 (12 mm) of the second end portion 128.

The middle portion 142 is formed by a hollow cylindrical shaft extending along said axis 126. The diameter D4 of the central hole 148 is 6 mm and the outer diameter D1 is 8 mm as compared to outer diameter D5 of the tube 142 of 1.1 mm, with an inner diameter D6 of 1 mm. The cross section of tube 142 is shown in enlarged manner in FIG. 8. The tube length is 49 mm. The ratio of the value of the tube length and the value of the inner diameter D6 therefore is 50. This value defines the transmission characteristics of the tube for high frequency pressure fluctuations as will be described later on. The wall thickness of tube 142 defines the mechanical stability and the temperature resistance of the tube and lies between 0.2 to 0.8 mm with a preferred value of approximately 0.5 mm.

For an effective cooling of the adaptor, in order to reduce the temperature of the mounted sensor below 200° C. with the temperature of wall 36 ranging up to 600° C. (rear stages of a high pressure compressor of a gas turbine), the middle portion is provided with two opposing elongated holes 150, 152 extending parallel to the axis 126 over almost the whole length of the middle portion 146. The width D7 of each hole is approximately 4 mm with a hole length of 30 mm. These holes 150, 152 allow entrance and exit of cooling fluid, namely cooling air used for cooling the outer surface of the wall 36. The cooling air serves for cooling the outer surface of the tube 148 and the inner surface of the cylindrical shaft of the hollow cylindrical shaft forming the middle portion 146.

In order to enlarge the inner cooling surface of the adaptor the central bore 148 of the hollow shaft, forming the middle portion 146, extends into the first end portion 124 ending at half the axial length of the end portion 124. This measure also reduces the material cross-section of the adaptor 110 in this region so that the temperature resistance is increased.

At the lower end of the mentioned central bore 148, the first end portion is provided with a diameter-reduced central bore 154 which is adapted to the outer diameter of the tube 142. According to FIG. 7 the tube ends in the plane of the lower radial face 136 of the first end portion 124. The tube 142 is sealingly tight-fitted into said bore 154 in the usual manner (soldering, brazing, welding).

The upper end of the tube 142 is likewise sealingly tight-fitted into a respective hole 156 at the lower end of the second end portion 128. This hole 156 is followed up by a reduced diameter hole 158, which opens into the recess 130. Thus, the above-mentioned channel form connecting the interior 120 of the gas turbine with the opening 132*e* of the sensor 32 is established. The axial length of the hole 158 is only 2 mm and the diameter of said hole is 1 mm so that the fluid transmitting characteristics of said fluid channel 34 are mainly defined by the tube 142.

For mounting the parts of the adaptor 110, it is preferred to first secure the tube 142 to the first end section 128 and then to insert the free end of the tube 42 into the bore 154 which is facilitated by a conical surface 160 connecting the larger central bore 148 of said adaptor with the smaller diameter bore 154. During said insertion the free end of the middle portion 146 comes into engagement with a reduced diameter end section 130*f* at the lower end of the second end portion 128. The outer diameter thereof fits with the inner diameter D4 of the middle portion 146 so that soldering or welding both parts together in this region, results in a mechanically stable construction.

FIG. 9 shows a graph with the frequency f of pressure fluctuations at the entrance side of the adaptor (at the lower end of tube 142 in FIG. 7) with constant amplitude compared with the signal U outputted from the piezoelectric sensor 32 (for example Kistler Pressure Sensor Type 6031). The frequency is indicated in Hertz (Hz) and the sensor signal U in volts (V). The measurements were effected by means of a reference pulsating pressure source which the adaptor 110 with pressure 32 was mounted to.

The measurements were made in the region between 0 Hz and 20.000 Hz. At a very low frequency around 0 Hz, the sensor signal shows a value of slightly more than 1 V. When increasing the frequency, but keeping the amplitude constant, the value of signal U drops for example to 0.09 V at a frequency of 4000 Hz and to a value of 0.02 V at 20 000 Hz.

Solid line L in FIG. 9 is an approximation graph for the measured values. This line L is derived from the following formula:

$$P2/P1=a*f^{b}*e^{f*c} \quad (4)$$

wherein P1 is the absolute pressure at the entrance end of the tube

P2 is the absolute pressure at the inner end of the tube (more exactly at the upper end of short hole 158 following tube 142)

Constants a, b and c depend on the dimensions of the fluid channel 134, that is on the dimensions of tube 142 since the length of hole 158 is very short compared to the length of tube 142. For the described configuration with a tube length of 50 mm and a tube diameter of 1 mm, the constants have the following values:

a=0,416 b=−0,003 c=−0,000186.

Since constants b and c are negative, this formula (4) shows that with increasing frequency the pressure P2 is steadily decreasing with a respective decrease of the sensor signal U as shown in FIG. 9.

Using this formula, it is possible to calculate the attenuation of the sensor signal in dependence on the frequency of the pressure inside the housing for all adaptor configurations with the same ratio of the value of the channel length and the inner diameter thereof. It is not necessary to effect calibration measurements when using a reference pulsating pressure source.

Only in those cases where the fluid channel between the entrance side of the adaptor and the sensor has irregular inner surfaces, formula 4 cannot be used so that calibrating methods will have to be performed.

The adaptor as described above may also be used in connection with other high temperature systems like chemical reactors, for example plug flow reactor, with relatively high wall temperatures and dynamic gas pressure fluctuations within said housing to be measured.

The present invention has been described in an illustrative manner. In this regard, it is evident that those skilled in the art, once given the benefit of the foregoing disclosure, may now make modifications to the specific embodiments described herein without departing from the spirit of the present invention. Such modifications are to be considered within the scope of the present invention which is limited solely by the scope and spirit of the appended claims.

What is claimed is:

1. Process for controlling an axial compressor, said axial compressor comprising:

a rotor, a housing, an inlet where, in operation, gas enters at a first pressure, and an outlet where, in operation, gas exits at a second pressure higher than said first pressure, said rotor being rotatably mounted within said housing for rotation about a rotational axis, said axial compressor further comprising at least one axial compressor stage, each said axial compressor stage comprising:

a row of rotor blades mounted on said rotor and being arranged one following the other in a circumferential direction with respect to said rotational axis, and a row of stator blades mounted on said housing and being arranged one following the other in a circumferential direction with respect to said rotational axis, each said axial compressor stage having, in operation, a turbulent fluid layer surrounding each said rotor in the region of said housing, each said axial compressor stage further having, in operation, a characteristic frequency defined as the product of the number of rotor blades mounted in said row of rotor blades and the rotational speed of said rotor, each said characteristic frequency having an associated frequency interval contiguous above and below said characteristic frequency, said process comprising the following steps:

controlling said axial compressor to a first load level and known rotational speed such that the first load level is sufficiently low in value to avoid the risk of surge and stall conditions in said axial compressor;

measuring the pressure fluctuations of at least one said turbulent fluid layer with a pressure sensing means responsive at the characteristic frequency for the known rotational speed and generating thereby at least one sensor signal;

deriving a plurality of frequency components within the frequency interval from each sensor signal, wherein one of the plurality of frequency components is derived at a frequency essentially equivalent to said characteristic frequency;

smoothing said plurality of frequency components into a frequency signal;

respective to the above steps, incrementally increasing the load on said axial compressor at said known rotational speed and performing the steps of measuring each resultant sensor signal, deriving respective resultant frequency components, and smoothing said respective resultant frequency components into a respective resultant frequency signal at each resulting load increment until at least one first characteristic peak is defined in a respective resultant frequency signal, said first characteristic peak having a frequency range proximate to said frequency interval and a mean frequency essentially equal to said characteristic frequency, and each said first characteristic peak further having at least one first peak parameter respective to those portions of the respective resultant frequency signal which are not a part of any said first characteristic peak;

retaining the value of said first peak parameter; respective to the above steps, further incrementally increasing the load on said axial compressor at said known rotational speed and performing the steps of measuring at least one resultant sensor signal, deriving respective resultant frequency components, and smoothing said respective resultant frequency components into a respective resultant frequency signal at the resulting load increment to define at least one second characteristic peak, said second characteristic peak having a frequency range proximate to said frequency interval and a mean frequency essentially equal to said characteristic frequency, and each said second characteristic peak further having at least one second peak parameter respective to that portion of the frequency signal which is not a part of any said second characteristic peak;

comparing the value of said second peak parameter with the value of said first peak parameter; incrementally modifying the load on said axial compressor at said known rotational speed to a higher level if the value of said second peak parameter is greater than or equal to the value of said first peak parameter, and to a lower level if the value of said second peak parameter is less than the value of said first peak parameter, and respective to the above steps, perpetually repeating the steps of measuring a subsequent sensor signal, deriving respective subsequent frequency components, smoothing said respective subsequent frequency components into a subsequent frequency signal, comparing a subsequent peak parameter value with its respective prior peak parameter value, retaining each peak parameter value as the prior peak parameter value for the subsequent comparing step, and incrementally modifying the load on said axial compressor on a periodic basis to, in each case, increase the load on said axial compressor at said known rotational speed to a higher level if the value of a peak parameter is greater than or equal to the value of its respective prior peak parameter, and decrease the load on said axial compressor to a lower level if the value of a peak parameter is less than the value of its respective prior peak parameter.

2. Process according to claim 1, wherein said pressure sensing means is connected to said housing between the rotor blades and the stator blades of one of said axial compressor stages.

3. Process according to claim 1, wherein said plurality of frequency components are derived by fast Fourier_transformation (FFT).

4. Process according to claim 1, wherein said plurality of frequency components are derived by fast Hartley transformation (FHT).

5. Process according to claim 1, wherein said pressure sensing means comprises a piezoelectric pressure sensor.

6. Process according to claim 1, wherein each said peak parameter is indicative of the peak height of the respective characteristic peak.

7. Process according to claim 6, wherein the peak height is defined as the ratio of a difference of a maximum value of said plurality of frequency components in the region of said characteristic frequency and a mean value of said plurality of frequency components within said frequency interval to said mean value.

8. Process according to claim 1, wherein each said peak parameter is indicative of a peak width of the respective characteristic peak.

9. Process according to claim 8, wherein said peak width is defined as full width at half maximum.

10. Process according to claim 1, wherein said frequency interval has a width of less than 4000 Hz.

11. Process according to claim 10, wherein said frequency interval has a width of 2000 Hz.

12. Process according to claim 1, wherein peak parameter values respective to at least two different axial compressor stages are retained and compared and wherein the load on said axial compressor is decreased to a lower level if the value of any of said peak parameter values is less than a respective threshold value after that peak parameter value has exceeded said threshold value.

13. Process according to claim 12, wherein said at least two different characteristic peaks are part of the plurality of frequency components derived from the sensor signal of a single pressure sensing means.

14. Process according to claim 12, wherein said at least two different characteristic peaks are part of respective frequency signals derived from respective sensor signals of at least two pressure sensing devices.

15. Process according to claim 1, wherein said peak parameter used for load incrementing is defined as a weighted sum of parameter values respective to at least two different characteristic peaks.

16. Process according to claim 15, wherein at least one of said peak parameter values is defined by the reciprocal of the peak height of the respective characteristic peak.

17. Process according to claim 15, wherein at least one of said peak parameters is defined by the peak height of the respective characteristic peak.

18. Process according to claim 15, wherein said peak parameter is defined as a weighted sum of a reciprocal of the peak height of the characteristic peak of the axial compressor stage nearest to the outlet, the reciprocal of the peak height of the characteristic peak of the second to the last axial compressor stage from the outlet and the peak height of the characteristic peak of the third to the last axial compressor stage from the outlet.

19. Process according to claim 15, wherein said peak parameter is defined as a weighted sum of the reciprocals of the peak height of the characteristic peaks assigned to the last axial compressor stage nearest to the outlet, the second to the last axial compressor stage nearest to the outlet, and the third to the last axial compressor stage nearest to the outlet.

20. Process according to claim 1, wherein said pressure sensing means comprises a piezoresistive pressure sensor.

21. Process for controlling an axial compressor, said axial compressor comprising:

a rotor, a housing, an inlet where, in operation, gas enters at a first pressure, and an outlet where, in operation, gas exits at a second pressure higher than said first pressure, said rotor being rotatably mounted within said housing for rotation about a rotational axis, said axial compressor further comprising at least one axial compressor stage, each said axial compressor stage comprising:

a row of rotor blades mounted on said rotor and being arranged one following the other in a circumferential direction with respect to said rotational axis, and a row of stator blades mounted on said housing and being arranged one following the other in a circumferential direction with respect to said rotational axis, each said axial compressor stage having, in operation, a turbulent fluid layer surrounding each said rotor in the region of said housing, each said axial compressor stage further having, in operation, a characteristic frequency defined as the product of the number of rotor blades mounted in said row of rotor blades and the rotational speed of said rotor, each said characteristic frequency having an associated frequency interval contiguous above and below said characteristic frequency, said axial compressor further having an associated stability control target value, said process comprising the following steps:

selecting a control set of a plurality of axial compressor stages;

identifying a sensor signal control parameter respective to both said control set and said stability control target value;

controlling said axial compressor to a first load level and known rotational speed such that the first load level is sufficiently low in value to avoid the risk of surge and stall conditions in said axial compressor;

measuring the pressure fluctuations of each said turbulent fluid layer respective to the control set with a pressure sensing means responsive at the characteristic frequency for the known rotational speed and generating thereby a sensor signal respective to each turbulent fluid layer;

deriving a plurality of frequency components within the frequency interval from each sensor signal in the control set, wherein one of the plurality of frequency components is derived at a frequency essentially equivalent to the characteristic frequency;

smoothing each said plurality of frequency components into a respective frequency signal;

respective to the above steps, incrementally increasing the load on said axial compressor at said known rotational speed and performing the steps of measuring each resultant sensor signal, deriving respective resultant frequency components, and smoothing said respective resultant frequency components into a respective resultant frequency signal at each resulting load increment until at least one first characteristic peak is defined in at least one respective resultant frequency signal, said first characteristic peak having a frequency range proximate to said frequency interval and a mean frequency essentially equal to said characteristic frequency, and said first characteristic peak further having at least one first peak parameter respective to those portions of the respective resultant frequency signal which are not a part of said first characteristic peak;

combining each first peak parameter value from each defined characteristic peak into a characteristic peak stability measurement respective to said sensor signal control parameter;

using the value of said characteristic peak stability measurement to define an increment of load change at said known rotational speed such that the difference between said characteristic peak stability measurement and said stability control target value will diminish;

using the increment of load change value to diminish the difference between said characteristic peak stability measurement and said stability control target value; and respective to the above steps, perpetually repeating the steps of measuring a plurality of subsequent sensor signals, deriving respective subsequent frequency components, smoothing said respective subsequent frequency components into subsequent frequency signals, combining each respective subsequently derived peak parameter value from each respective subsequent characteristic peak into a subsequent characteristic peak stability measurement, and using the value of said subsequent characteristic peak stability measurement to control said axial compressor at said known rotational speed to achieve said stability control target value.

22. Process according to claim 21, wherein said pressure sensing means comprises a piezoresistive pressure sensor.

23. Process according to claim 21, wherein said plurality of frequency components are derived by fast Fourier transformation (FFT).

24. Process according to claim 21, wherein said plurality of frequency components are derived by fast Hartley transformation (FHT).

25. Computer implemented system for controlling an axial compressor, said axial compressor comprising:

a rotor, a housing, an inlet where, in operation, gas enters at a first pressure, and an outlet where, in operation, gas exits at a second pressure higher than said first pressure, said rotor being rotatably mounted within said housing for rotation about a rotational axis, said axial compressor further comprising at least one axial compressor stage, each said axial compressor stage comprising:

a row of rotor blades mounted on said rotor and being arranged one following the other in a circumferential direction with respect to said rotational axis, and a row of stator blades mounted on said housing and being arranged one following the other in a circumferential direction with respect to said rotational axis, each said axial compressor stage having, in operation, a turbulent fluid layer surrounding each said rotor in the region of said housing, each said axial compressor stage further having, in operation, a characteristic frequency defined as the product of the number of rotor blades mounted in said row of rotor blades and the rotational speed of said rotor, each said characteristic frequency having an associated frequency interval contiguous above and below said characteristic frequency, said computer implemented system comprising:

a compressor control unit for controlling said axial compressor to a first load level and known rotational speed such that the first load level is sufficiently low in value to avoid the risk of surge and stall conditions in said axial compressor and for subsequently increasing, decreasing, and modifying the load on said axial compressor;

pressure sensing means responsive at said characteristic frequency for measuring the pressure fluctuations of at least one said turbulent fluid layer and generating thereby at least one sensor signal; and an evaluation unit for:

deriving a plurality of frequency components within the frequency interval from each sensor signal, wherein one of the plurality of frequency components is derived at a frequency essentially equivalent to said characteristic frequency, smoothing said plurality of frequency components into a frequency signal, prompting said compressor control unit to incrementally increase the load on said axial compressor at said known rotational speed, deriving respective resultant frequency components from each resultant sensor signal, and smoothing said respective resultant frequency components into a respective resultant frequency signal at each resulting load increment respective to the above operations until at least one first characteristic peak is defined in a respective resultant frequency signal, said first characteristic peak having a frequency range proximate to said frequency interval and a mean frequency essentially equal to said characteristic frequency, and each said first characteristic peak further having at least one first peak parameter respective to those portions of the respective resultant frequency signal which are not a part of said first characteristic peak, retaining the value of said first peak parameter, further prompting said compressor control unit to incrementally increase the load on said axial compressor at said known rotational speed, deriving the respective resultant frequency components from each resultant sensor signal, and smoothing said respective resultant frequency components into a respective resultant frequency signal respective to the above operations to define at least one second characteristic peak, said second characteristic peak having a frequency range proximate to said frequency interval and a mean frequency essentially equal to said characteristic frequency, and each said second characteristic peak further having at least one second peak parameter respective to that portion of the frequency signal which is not a part of any said second characteristic peak, comparing the value of said second peak parameter with the value of said first peak parameter, further prompting said compressor control unit to incrementally modify the load on said axial compressor at said known rotational speed to a higher level if the value of said second peak parameter is greater than or equal to the value of said first peak parameter, and to a lower level if the value of said second peak parameter is less than the value of said first peak parameter, and respective to the above operations, perpetually repetitively deriving respective subsequent frequency components from each subsequent sensor signal, smoothing said respective subsequent frequency components into a subsequent frequency signal, retaining a peak parameter value so that a prior peak parameter value is available for the subsequent comparison step, comparing a subsequent peak parameter value with its respective prior peak parameter value, and prompting said compressor control unit to incrementally modify the load on said axial compressor on a periodic basis to, in each case, increase the load on said axial compressor at said known rotational speed to a higher level if the value of a peak parameter is greater than or equal to the value of its respective prior peak parameter, and decrease the load on said axial compressor to a lower level if the value of a peak parameter is less than the value of its respective prior peak parameter.

26. Computer implemented system according to claim 25, wherein said pressure sensing means is connected to said housing between the rotor blades and the stator blades of one of said axial compressor stages.

27. Computer implemented system according to claim 25, wherein said pressure sensing means comprises a piezoelectric pressure sensor.

28. Computer implemented system according to claim 25, wherein said evaluation unit comprises a fast Fourier_ transformation unit.

29. Computer implemented system according to claim 25, wherein said evaluation unit comprises a fast Hartley_ transformation unit.

30. Computer implemented system according to claim 25, wherein said pressure sensing means comprises a piezoresistive pressure sensor.

31. Computer implemented system for controlling an axial compressor, said axial compressor comprising:

a rotor, a housing, an inlet where, in operation, gas enters at a first pressure, and an outlet where, in operation, gas exits at a second pressure higher than said first pressure, said rotor being rotatably mounted within said housing for rotation about a rotational axis, said axial compressor further comprising at least one axial compressor stage, each said axial compressor stage comprising:

a row of rotor blades mounted on said rotor and being arranged one following the other in a circumferential direction with respect to said rotational axial, and a row of stator blades mounted on said housing and being arranged one following the other in a circumferential direction with respect to said rotational axis, each said axial compressor stage having, in operation, a turbulent fluid layer surrounding each said rotor in the region of said housing, each said axial compressor stage further having, in operation, a characteristic frequency defined as the product of the number of rotor blades mounted in said row of rotor blades and the rotational speed of said rotor, each said characteristic frequency having an associated frequency interval contiguous above and below said characteristic frequency, said axial compressor further having a stability control target value, said computer implemented system comprising:

a compressor control unit for controlling said axial compressor to a first load level and known rotational speed such that the first load level is sufficiently low in value to avoid the risk of surge and stall conditions in said axial compressor and for subsequently increasing, decreasing, and modifying the load on said axial compressor;

pressure sensing means responsive at said characteristic frequency for measuring the pressure fluctuations of each said turbulent fluid layer respective to a preselected control set of a plurality of axial compressor stages and generating thereby a sensor signal respective to each turbulent fluid layer; and an evaluation unit for:

deriving a plurality of frequency components within the frequency interval from each sensor signal in the control set, wherein one of the frequency components is derived at a frequency essentially equivalent to the characteristic frequency, smoothing each said plurality of frequency components into a respective frequency signal, prompting said compressor control unit to incrementally increase the load on said axial compressor at said known rotational speed, deriving respective resultant frequency components from each resultant sensor signal, and smoothing said respective resultant frequency components into a respective resultant fequency signal at each resulting load increment respective to the above operations until a first characteristic peak is defined in at least one frequency signal, said first characteristic peak having a frequency range proximate to said frequency interval and a mean frequency essentially equal to said characteristic frequency, and said first characteristic peak further having at least one first peak parameter respective to those portions of the respective resultant frequency signal which are not a part of said first characteristic peak, combining each first peak parameter value from each defined characteristic peak into a characteristic peak stability measurement respective to a preidentified sensor signal control parameter respective to both said control set and said stability control target value, using the value of said characteristic peak stability measurement to define an increment of load change at said known rotational speed such that the difference between said characteristic peak stability measurement and said stability control target value will diminish, prompting said compressor control unit to use the increment of load change value to diminish the difference between said characteristic peak stability measurement and said stability control target value, and respective to the above operations, perpetually repetitively deriving respective subsequent frequency components from each of the plurality of subsequent sensor signals, smoothing said respective subsequent frequency components into a subsequent frequency signals, combining each respective subsequently derived peak parameter value from each respective subsequent characteristic peak into a subsequent characteristic peak stability measurements, and prompting said compressor control unit to use the value of said subsequent characteristic peak stability measurement to control said axial compressor at said known rotational speed to achieve said stability control target value.

32. Computer implemented system according to claim 31, wherein said pressure sensing means is connected to said housing between the rotor blades and the stator blades of one of said axial compressor stages.

33. Computer implemented system according to claim 31, wherein said pressure sensing means comprises a piezoelectric pressure sensor.

34. Computer implemented system according to claim 31, wherein said evaluation unit comprises a fast Fourier_ transformation unit.

35. Computer implemented system according to claim 31, wherein said evaluation unit comprises a fast Hartley_ transformation unit.

36. Computer implemented system according to claim 31, wherein said pressure sensing means comprises a piezoresistive pressure sensor.

* * * * *